US008162052B2

(12) United States Patent
Goodwin et al.

(10) Patent No.: US 8,162,052 B2
(45) Date of Patent: Apr. 24, 2012

(54) FORMATION TESTER WITH LOW FLOWLINE VOLUME AND METHOD OF USE THEREOF

(75) Inventors: Anthony R. H. Goodwin, Sugar Land, TX (US); Julian J. Pop, Houston, TX (US); Stephane Briquet, Houston, TX (US); Ricardo Vasques, Bailly (FR); Alexander Zazovsky, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 149 days.

(21) Appl. No.: 12/357,133

(22) Filed: Jan. 21, 2009

(65) Prior Publication Data

US 2009/0211756 A1 Aug. 27, 2009

Related U.S. Application Data

(60) Provisional application No. 61/022,996, filed on Jan. 23, 2008.

(51) Int. Cl.
*E21B 49/08* (2006.01)
*E21B 49/10* (2006.01)
*E21B 27/00* (2006.01)

(52) U.S. Cl. ..... 166/264; 166/165

(58) Field of Classification Search ..... 166/264, 166/165; 175/59, 308; 73/152.23–152.26
See application file for complete search history.

(56) References Cited

U.S. PATENT DOCUMENTS

| | | | | |
|---|---|---|---|---|
| 2,693,342 | A | 11/1954 | Lynes | |
| 3,104,712 | A | 9/1963 | Whitten | |
| 3,859,851 | A | 1/1975 | Urbanosky | |
| 4,353,249 | A | 10/1982 | Lagus et al. | |
| 4,392,376 | A | 7/1983 | Lagus et al. | |
| 4,485,868 | A * | 12/1984 | Sresty et al. | 166/248 |
| 4,860,581 | A | 8/1989 | Zimmerman et al. | |
| 4,936,139 | A | 6/1990 | Zimmerman et al. | |
| 5,056,595 | A | 10/1991 | Desbrandes | |
| 6,065,544 | A | 5/2000 | Holbert | |
| 6,208,316 | B1 | 3/2001 | Cahill | |
| 6,269,882 | B1 | 8/2001 | Wellington et al. | |
| 6,301,959 | B1 | 10/2001 | Hrametz et al. | |
| 6,699,019 | B2 | 3/2004 | Myers et al. | |

(Continued)

FOREIGN PATENT DOCUMENTS

GB 2418938 4/2006

(Continued)

OTHER PUBLICATIONS

Burgess, Keith et al., Formation Testing and Sampling Through Casing, Oilfield Review, Spring 2002, pp. 47-57.

*Primary Examiner* — Cathleen Hutchins
(74) *Attorney, Agent, or Firm* — David J Smith

(57) ABSTRACT

A downhole tool for use in a well may comprise a vessel having a piston or a valve disposed therein and defining first and second volumes wherein the first volume is configured to receive formation fluid from an inlet port, and an actuator configured to extract formation fluid, the actuator being fluidly isolated from a fluid flow path extending between the inlet port and the first volume. The downhole tool may also comprise a flow-line configured to deliver formation fluid to the vessel, and an actuator configured to register an end of the flow-line with the inlet of the vessel.

21 Claims, 9 Drawing Sheets

U.S. PATENT DOCUMENTS

| | | | | |
|---|---|---|---|---|
| 6,755,246 | B2 | 6/2004 | Chen et al. | |
| 6,766,854 | B2 | 7/2004 | Ciglenec et al. | |
| 2003/0217845 | A1 | 11/2003 | Sherwood et al. | |
| 2004/0093937 | A1 | 5/2004 | Hashem | |
| 2004/0104341 | A1 | 6/2004 | Betancourt et al. | |
| 2005/0155760 | A1 | 7/2005 | Hill et al. | |
| 2005/0279499 | A1 | 12/2005 | Tarvin et al. | |
| 2006/0000606 | A1 | 1/2006 | Fields et al. | |
| 2006/0042793 | A1* | 3/2006 | Del Campo et al. | 166/264 |
| 2006/0137873 | A1 | 6/2006 | Caudwell et al. | |
| 2006/0155472 | A1* | 7/2006 | Venkataramanan et al. | 702/10 |
| 2006/0162935 | A1 | 7/2006 | MacDougall | |
| 2006/0248949 | A1 | 11/2006 | Gregory et al. | |
| 2007/0215348 | A1 | 9/2007 | Corre | |
| 2008/0066904 | A1 | 3/2008 | Van Hal et al. | |
| 2008/0078581 | A1 | 4/2008 | Goodwin et al. | |
| 2008/0156486 | A1 | 7/2008 | Ciglenec et al. | |
| 2009/0008079 | A1 | 1/2009 | Zazovsky et al. | |

FOREIGN PATENT DOCUMENTS

| | | |
|---|---|---|
| GB | 2420135 | 5/2006 |
| GB | 2431673 | 5/2007 |
| GB | 2445846 | 7/2008 |
| WO | WO2007048991 | 5/2007 |
| WO | WO2008036520 | 3/2008 |
| WO | WO2008150825 | 12/2008 |

* cited by examiner

FORMATION TESTER WITH LOW FLOWLINE VOLUME AND METHOD OF USE THEREOF

CROSS-REFERENCE TO RELATED APPLICATIONS

This application claims the benefit of U.S. Provisional Application No. 61/022,996, entitled "FORMATION TESTER WITH LOW FLOWLINE VOLUME," filed Jan. 23, 2008, the disclosure of which is hereby incorporated herein by reference. This application is also related to U.S. patent application Ser. No. 12/368,738, filed on Feb. 10, 2009, and titled "Single Packer System for Use in Heavy Oil Environments."

BACKGROUND OF THE DISCLOSURE

Formation testers and related sampling procedures for acquiring conventional oil samples from underground formations have been described in U.S. Pat. Nos. 4,860,581 and 4,936,139, amongst others. Example sampling procedures may include the use of sampling probes of various geometries and/or packer assemblies to fluidly connect the formation tester to the formation and extract fluid from the formation. Within the formation tester, flow-lines usually convey the fluid extracted from the formation through fluid analyzers, and eventually to one or more of a plurality of sample storage vessels that may be located several meters away from the point of entry (e.g. a sampling port) of the formation fluid into the formation tester. Typically, the diameter of the flow-lines may be on the order of 10 mm. Thus, the volume of an average 10 m flow-line between the point of entry of the formation fluid and a sample storage vessel may be approximately 800 $cm^3$.

During sampling operations, the fluid initially present in the flow-lines is pumped out of the testing tool into the wellbore, and is progressively replaced by formation fluid extracted from the formation. In the cases when conventional oil (i.e. oil relatively mobile in the formation) is sampled, the flow-line volume is small compared with the volume of fluid that is usually extracted from the formation during a sampling operation. Indeed, it is not unusual to pump a volume on the order of 10,000 $cm^3$ during the sampling operation, which is more than 10 times the flow-line volume mentioned above. Thus, the flow-line volume in the formation tester has usually a negligible impact on the sampling procedure. However, in the cases when heavy oil or bitumen, (i.e. hydrocarbon that may not be mobile at reservoir conditions) is sampled, it may be difficult to mobilize and extract a volume of formation fluid corresponding to the flow-line volume in addition to the volume of the fluid to be captured in a vessel of the formation tester.

For example, mobilizing the heavy oil and bitumen may be achieved by increasing the temperature of the formation near a sampling port of the formation tester. It should be appreciated that the thermal diffusivity of formations is many orders of magnitude lower than the thermal diffusivity of, for example, metals. Thus, the time required for the thermal wave to penetrate the formation sufficiently far into the reservoir to permit the temperature of an adequate volume of fluid to be increased and/or an adequate volume of fluid to be mobilized may be long. In particular, when using a resistive heating element positioned on the bore-hole wall, mobilizing about 1,000 $cm^3$ of fluid close to a sampling probe while minimizing the thermal degradation of the hydrocarbon may require the formation to be heated for about two days. If mobilizing an additional volume of 1,000 $cm^3$ is desired, then on the order of one more day may be required.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
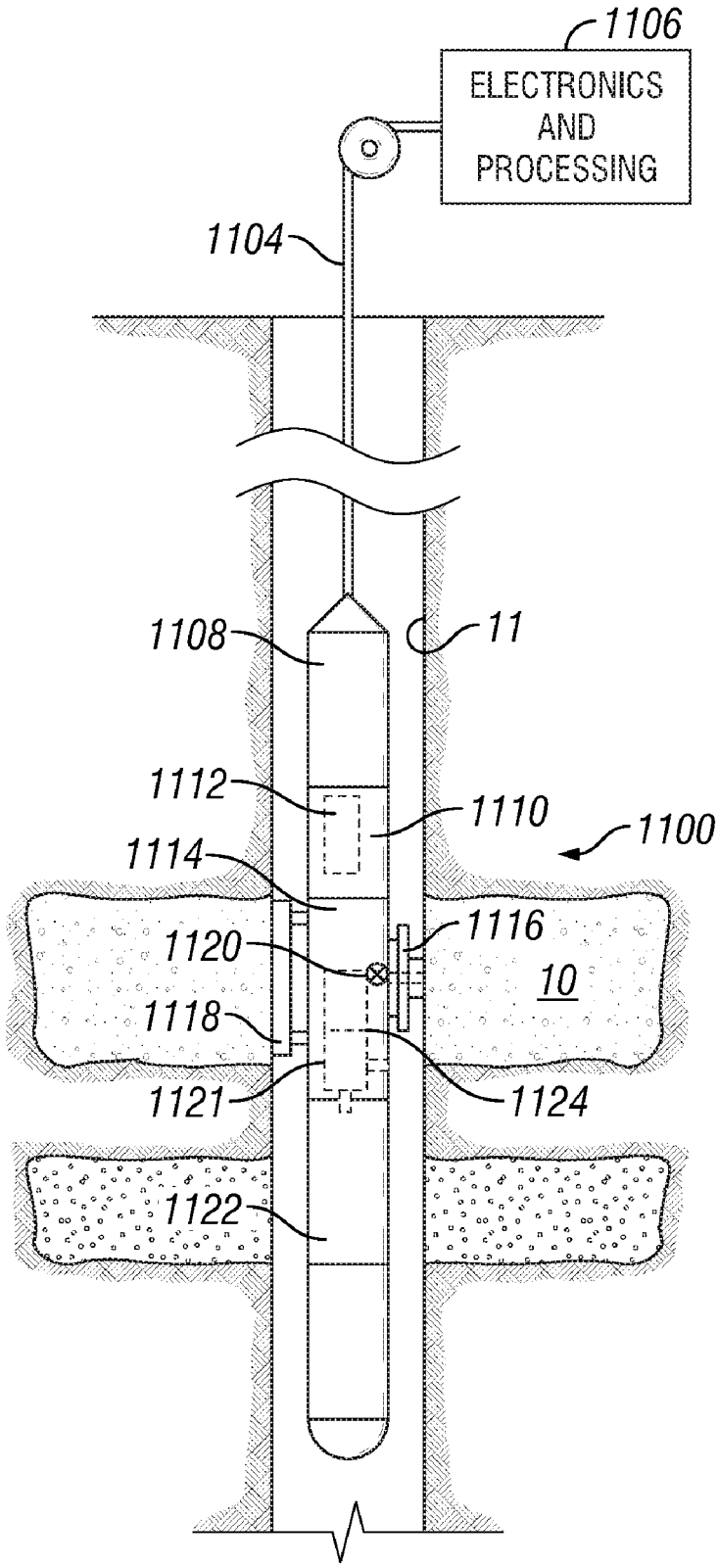
FIG. 1 is a schematic view of an apparatus according to one or more aspects of the disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Formation testers configured to obtain an aliquot of formation fluid in one or more sample vessel(s) are disclosed herein. Preferably, the location and type of sample vessel(s) conveyed by the formation testers are configured to provide a low volume of flow-line between a sampling port and the sample vessel(s) conveyed by the tool. For example, the sample vessel(s) may be disposed close to a sampling port of the tool (e.g. within one meter of a sampling probe) so that the flow-line volume between the sampling port and the sample vessel is low.

In some cases, the formation testers disclosed herein may be configured to obtain samples that are representative of a hydrocarbon substance found in the formation. In particular, the formation testers may be configured to sample formation fluid, such as heavy oils, that are not mobile at reservoir temperature, or other hydrocarbons that are effectively solid at reservoir temperature, such as bitumen. Thus, the formation testers of the present disclosure may be provided with one or more mobilizer(s) (e.g. heat sources, chemical injectors, etc) configured to reduce the formation fluid viscosity in at least a portion of the formation and thus, mobilize formation fluid to facilitate sampling. However, the formation testers disclosed herein could equally well be used in other reservoir types, such as gas-condensate reservoirs, or more generally in reservoirs where it was deemed useful to minimize the volume of extracted fluid to obtain a sample.

Turning to FIG. 1, an example wireline tool 1100 that may be used to extract and capture one or more formation fluid sample(s) is suspended in a wellbore 11 from the lower end of a multiconductor cable 1104 that is spooled on a winch (not shown) at the Earth's surface. At the surface, the cable 1104 is communicatively coupled to an electrical control and data acquisition system 1106. The wireline tool 1100 includes an elongated body 1108 that may comprises a telemetry module 1110 having a downhole control system 1112 communicatively coupled to the electrical control and data acquisition system 1106 and configured to control extraction of formation fluid from the formation 10, as well as store and/or communicate data indicative of the sampling operation to the surface for subsequent analysis at the surface.

The elongated body 1108 may also includes a formation tester 1114 having a selectively extendable fluid admitting assembly 1116 and a selectively extendable tool anchoring member 1118 that are respectively arranged on opposite sides of the elongated body 1108. The fluid admitting assembly 1116 may be configured to selectively seal off or isolate selected portions of the wall of the wellbore 11 to fluidly couple internal flow-lines in the formation tester 1114 to the adjacent formation 10. The fluid admitting assembly 1116 may be used to draw fluid samples from the formation 10 and capture the samples into one or more vessel(s) 1121 fluidly coupled to an inlet of the fluid admitting assembly 1116.

The vessel 1121 may include a valve 1120 through which formation fluid samples may flow. The valve 1120 may be configured to selectively capture and seal samples in the vessel 1121. Thus, the vessel 1121 may receive and retain the formation fluid for subsequent testing at the surface or a testing facility. The vessel 1121 may include a piston 1124 slidably disposed therein, the piston defining a first volume fluid coupled to the inlet of the probe assembly 1116 and a second volume isolated from the inlet of the probe assembly 1116 by the piston 1124. An actuator 1122 (e.g. a pump) may also be provided by the formation tester 1114 and may be configured to pull or reciprocate the piston 1124. For example, the actuator 1122 may be configured to reduce the vessel second volume thereby extracting formation fluid from the formation 10 and receiving the formation fluid in the vessel first volume. The actuator 1122 may be fluidly isolated from a fluid flow path extending between the inlet port or the fluid admitting assembly 1116 and the first volume of the vessel 1121. In particular, the actuator 1122 may be disposed at least in part in the second volume of the vessel 1121.

In the illustrated example, the electrical control and data acquisition system 1106 and/or the downhole control system 1112 may be configured to control the fluid admitting assembly 1116 to draw fluid samples from the formation 10, to control the actuator 1122 to controllably reduce the vessel second volume, and/or to close the valve 1120 for capturing the sample of the downhole fluid in the vessel 1121. Further, the electrical control and data acquisition system 1106 and/or the downhole control system 1112 may be configured to control one or more mobilizer(s) (not shown) used to mobilize the downhole fluid in at least a portion of the formation prior to or during sampling.

Figure 2A:
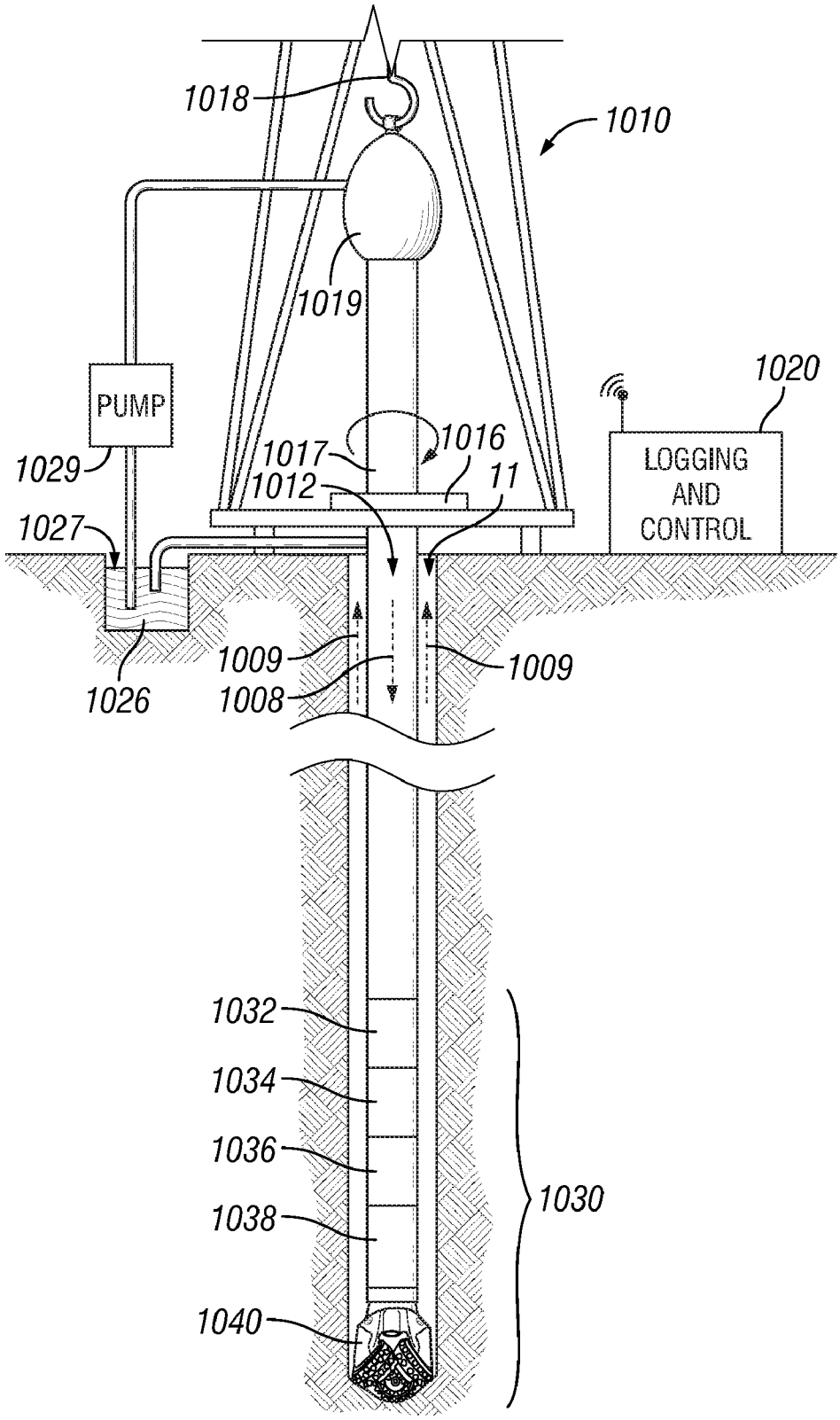
FIG. 2A is a schematic view of another apparatus according to one or more aspects of the disclosure.

FIG. 2A illustrates a wellsite system in which the example implementations can be employed. The wellsite can be onshore or offshore. In this example system, a borehole 11 is formed in subsurface formations by rotary drilling in a manner that is well known. Some example implementations can also use directional drilling.

A drill string 1012 is suspended within the borehole 11 and has a bottom hole assembly 1030 that includes a drill bit 1040 at its lower end. The wellsite system includes a platform and derrick assembly 1010 positioned over the borehole 11. The assembly 1010 includes a rotary table 1016, a kelly 1017, a hook 1018 and a rotary swivel 1019. The drill string 1012 is rotated by the rotary table 1016, energized by means not shown, which engages the kelly 1017 at the upper end of the drill string 1012. The drill string 1012 is suspended from the hook 1018, which is attached to a traveling block (also not shown), through the kelly 1017 and the rotary swivel 1019, which permits rotation of the drill string 1012 relative to the hook 1018. As is well known, a top drive system could alternatively be used.

In the illustrated example implementation, the wellsite system further includes drilling fluid or mud 1026 stored in a pit 1027 formed at the well site. A pump 1029 delivers the drilling fluid 1026 to the interior of the drill string 1012 via a port in the rotary swivel 1019, causing the drilling fluid 1026 to flow downwardly through the drill string 1012 as indicated by a directional arrow 1008. The drilling fluid 1026 exits the drill string 1012 via ports in the drill bit 1040, and then circulates upwardly through the annulus region between the outside of the drill string 1012 and the wall of the borehole 11, as indicated by directional arrows 1009. In this well-known manner, the drilling fluid 1026 lubricates the drill bit 1040 and carries formation cuttings to the surface as it is returned to the pit 1027 for recirculation.

The bottom hole assembly (BHA) 1030 of the illustrated example implementation includes a logging-while-drilling (LWD) module 1032, a measuring-while-drilling (MWD) module 1034, a roto-steerable system and motor 1038, and drill bit 1040. In the illustrated example, the bottom assembly 1030 is communicatively coupled to a logging and control unit 1020. The logging and control unit 1020 may be configured to receive data from and control the operation of the logging-while-drilling (LWD) module 1032, the measuring-while-drilling (MWD) module 1034, and the roto-steerable system and motor 1038. In particular, the logging and control unit 1020 may be configured to control the trajectory of the borehole 11 based on data collected from one or more component of the BHA 1030, as well as a reference data base (not shown) coupled to the logging and control unit 1020. While the logging and control unit 1020 is depicted on the well site in FIG. 2A, at least a portion of the logging and control unit 1020 may alternatively be provided at a remote location.

The LWD module 1032 is housed in a special type of drill collar, as is known in the art, and can contain one or a plurality of known types of logging tools. It will also be understood that more than one LWD and/or MWD module can be employed (e.g., as represented at 1036). (References, throughout the following description, to a module at the position of 1032 can alternatively mean a module at the position of 1036 as well.) The LWD module 1032 includes capabilities for measuring, processing, and storing information, as well as for communicating with the MWD module 1034. In the illustrated example implementation, the LWD module 1032 includes a sampling device (not shown).

The MWD module 1034 is also housed in a special type of drill collar, as is known in the art, and can contain one or more devices for measuring characteristics of the drill string 1012 and the drill bit 1040. The MWD module 1034 further includes an apparatus (not shown) for generating electrical power to the downhole system. This may typically include a mud turbine generator powered by the flow of the drilling fluid 1026, it being understood that other power and/or battery systems may be employed. In the illustrated example implementation, the MWD module 1034 includes one or more of the following types of measuring devices: a weight-on-bit measuring device, a torque measuring device, a vibration measuring device, a shock measuring device, a stick slip measuring device, a direction measuring device, and an inclination measuring device. The MWD module 1034 also includes capabilities for processing, and storing information signals from the LWD module 1032 and 1036, as well as for communicating with the surface equipment.

Figure 2B:
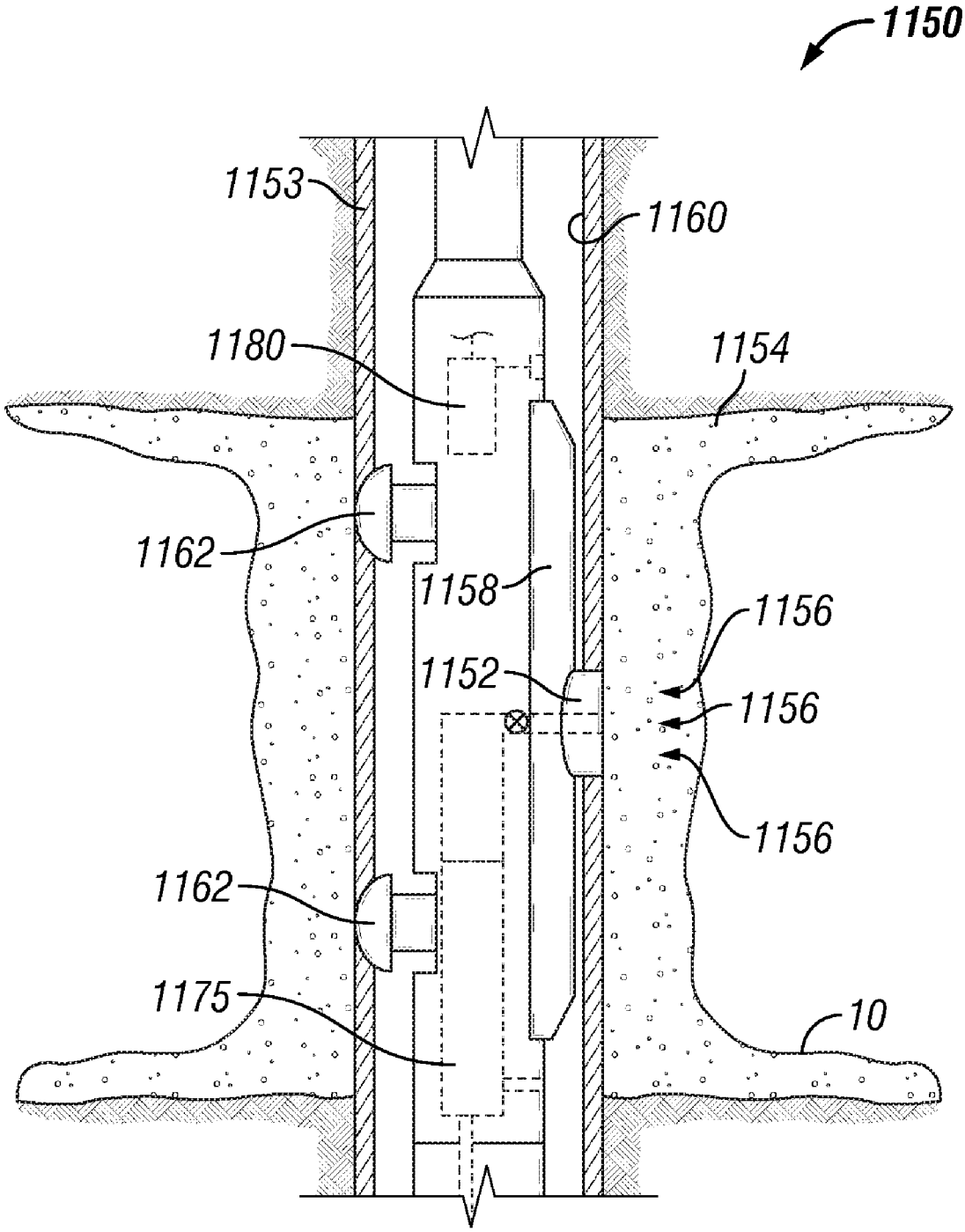
FIG. 2B is a schematic view of the sampling apparatus shown in FIG. 2A.

FIG. 2B is a simplified diagram of a sampling-while-drilling logging device 1150 (LWD tool 1150), and may be used to implement the LWD module 1036 of FIG. 2A. A probe 1152 may extend from a stabilizer blade 1158 of the LWD tool 1150 to engage a bore wall 1160 that may in some cases be lined by a mud cake 1153. The stabilizer blade 1158 includes one or more blades that engage the bore wall 1160. The LWD tool 1150 may be provided with a plurality of backup pistons 1162 to assist in applying a force to push and/or move the LWD tool 1150 and/or the probe 1152 against the bore wall 1160.

The probe 1152 is configured to selectively seal off or isolate selected portions of the wall of the wellbore 1160 to fluidly couple to the adjacent formation 10 and draw fluid samples from the formation 10 into the LWD tool 1150 in a direction generally indicated by arrows 1156, for example by using a syringe pump 1175 (for example similar to the pump 1121 of FIG. 1). Once the probe 1152 fluidly couple to the adjacent formation 10, various measurements may be conducted on the sample such as, for example, a pretest parameter or a pressure parameter may be measured.

In the illustrated example, a downhole control system 1180 is configured to control the operations of the LWD module 1150 to draw fluid samples from the formation 10 and in particular to control the syringe pump 1175 during sampling operations. Further, the downhole control system 1180 may have capabilities for processing, and storing information collected by downhole sensors (not shown), in particular for subsequent retrieval at the surface and/or for real time communication with the surface equipment. Still further, the downhole control system 1180 may be configured to control one or more mobilizer(s) (not shown) used to mobilize the downhole fluid in at least a portion of the formation prior to or during sampling.

Figure 3:
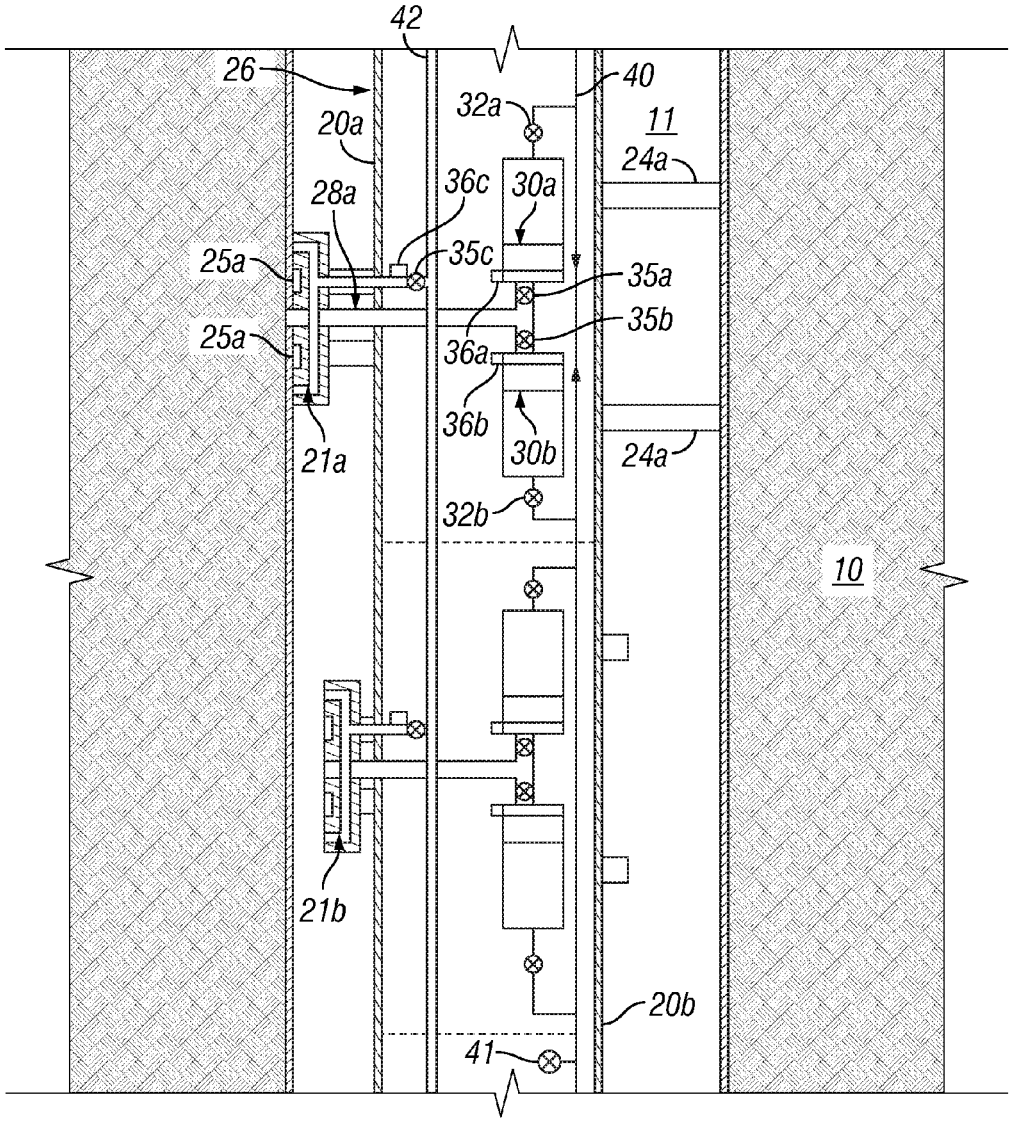
FIG. 3 is a schematic cross sectional view of a modular testing tool lowered in a wellbore having a low flow-line volume between a sampling port and a tree of sample storage vessels.

FIG. 3 shows a diagram of a modular testing tool 26 lowered in a wellbore 11 penetrating a subterranean formation 10. The testing tool 26 may be conveyed by wire-line, drill-pipe, or tubing or any other means used in the industry. For the sake of brevity and clarity, only a portion of the components of the tool 26 are depicted in FIG. 3.

The modular tool 26 comprises preferably, but not necessarily a plurality of modules of similar functionality. In FIG. 3, a first testing module 20*a* is depicted in a sampling position and a second module 20*b*, comparable to the first module 20*a*, is depicted in a conveyance position. The testing modules 20*a*, 20*b* are each provided with a probe, denoted respectively by 21*a*, 21*b*, and defining a sampling port or inlet of the testing tool. In the extended position, the probe 21*a* is pressed against a wall of the wellbore 11 with setting pistons 24*a*. When set, the probe 21*a* sealingly engages a wall of the wellbore 11, establishing thereby an exclusive fluid communication between the flow-line 28*a* and the formation 10.

For sampling some reservoirs, such as heavy oil or bitumen reservoirs, the tool 26 may be provided with means for mobilizing of the hydrocarbon in the formation 10. In one example, the probe 21*a* is provided with heating pads 25*a* (e.g. a resistive heating element) that are applied against the formation as the probe 21*a* is extended. The heating pads 25*a* generate heat that is conducted in a portion of the formation close to the probe. The conducted heat elevates the temperature of the hydrocarbon within the formation, thereby reducing its viscosity. In another example, the probe 21*a* is provided with electro-magnetic transducers for propagating an electro-magnetic field in a portion of the formation. Consequently, the electro-magnetic field may generate an inductive or galvanic current in the portion of the formation. Because of the resistance of the formation, the current may be converted into heat in the portion of the formation. Accordingly, the temperature of the hydrocarbon may increase, thereby reducing its viscosity. The electro-magnetic field may have frequency components ranging from DC to several GHz.

While electrical heat sources have been discussed with respect FIG. 3, other heat sources may alternatively be used, such as chemical heat sources, for example as disclosed in U.S. Pat. App. Pub. No. 2008/0066904, incorporated herein by reference. Further, while particular methods of heat delivery to the formation have been discussed with respect to FIG. 3, other delivery methods, including perforating the formation, may also be used, for example as disclosed in U.S. Pat. App. Pub. No. 2008/0078581, incorporated herein by reference. Still further, while increasing the temperature of the formation near the probe has been discussed with respect to FIG. 3, plausible means for mobilizing the heavy oil and bitumen to permit sampling also include injecting a diluent. However, the use of a solvent may result in the precipitation of asphaltenes in the formation and the acquisition of an unrepresentative sample.

To draw fluid from the formation, and in particular a portion of the hydrocarbon that has been mobilized with the heat pads 25*a*, the testing tool 26 is provided with one or more syringe pump(s) fluidly connected to the flow line 28*a*. In FIG. 3, two syringe pumps are implemented with vessels 30*a* and 30*b*, each of which includes a piston slidably disposed therein. The piston defines a first volume configured to receive formation fluid from the probe inlet and a second volume fluidly isolated from the first volume. The flow of fluid in the flow-line 28*a* to and/or from the vessels 30*a* and 30*b* is controlled by valves 35*a* and 35*b*, respectively. In particular, valves 35*a* and 35*b* may be selectively opened for receiving formation fluid therein. Also, valves 35*a* and 35*b* may be closed once a fluid has been collected in the vessels 30*a*, and 30*b* respectively. By closing the valves 35*a* and 35*b*, the sample collected in the vessels 30*a*, and 30*b* respectively may be isolated from the flow-line 28*a* for transporting the sample to the surface.

To control the movement of the piston in the vessels 30*a* and 30*b*, the testing tool 26 is provided with a hydraulic line 40, that is connected to a pump (not shown). The hydraulic line 40 is preferably provided with a pressure sensor 41 for monitoring and controlling the pressure of the hydraulic fluid therein. The hydraulic line 40 is connected to the second volume of each of the vessels 30*a* and 30*b* through valves 32*a* and 32*b* respectively. To draw formation fluid in the vessel 30*a*, the pressure in the flow line 40 is, for example, lowered at least below the formation pressure, and in some cases with a minimal decrease in pressure with respect to the formation pressure. The valve 32*a*, e.g. a needle valve, is opened for controlling the flow-rate of hydraulic fluid leaving the vessel 30*a*, and consequently, the movement of the piston disposed in the vessel 30*a*. Fluid, for example mobilized fluid, may thus be extracted from the formation and enter the vessel 30*a*. Controlling at least one of the pressure and the flow rate in the flow line 40 as fluid enters a vessel may insure that the received sample is representative of the formation substance, so that the sample can be used to determine the chemical and physical properties to assist, for example, with the definition of a suitable production strategy. In addition, controlling the pressure of the captured sample may insure that the samples remain representative of the formation substance during transportation of the sample to the surface.

In some cases, the sampled hydrocarbon (e.g. the sampled heavy oil) may be such that the fluid extracted from the formation does not readily flow through the hydraulic components of the testing tool 26. The hydrocarbon could, for example, create a blockage within the flow-line between the sampling probe and the storage vessel (e.g. flow-line 28*a*). In these cases, the testing tool may be advantageously provided with probe and/or flow line heating means (not shown), for example as disclosed in G.B. Pat App. No 2,431,673, incorporated herein by reference.

To measure physiochemical properties of the fluid extracted from the formation, vessels 30*a* and 30*b* may be provided with instruments 36*a* and 36*b*, respectively. The instrument 36*a* and/or 36*b* are configured to measure one or more of a fluid composition, a density, a viscosity, a thermal conductivity, a heat capacity and a complex electric permittivity of the sample received in the vessel. The instrument 36*a* and/or 36*b* may alternatively be disposed on the flow-line 28*a*; however in this alternative, the volume between the inlet of the sampling probe and the vessel may be larger than in the case the instrument 36*a* and/or 36*b* is disposed in the vessel 30*a* and/or 30*b*.

It should be appreciated that the testing tool 26 is preferably capable of capturing in the storage vessels an aliquot of formation hydrocarbon having a composition that represents the important characteristics of the reservoir characteristics sufficiently well. A sufficient volume of formation hydrocarbon should be captured in the vessels, so that Pressure-Volume-Temperature (PVT) analyses at surface in a laboratory may be performed. The minimal volume of formation hydrocarbon that may be required to provide representative physicochemical properties values in a laboratory is on the order of 10 $cm^3$. In many hydrocarbon reservoirs, the fluid extracted from the formation also contains formation water together with hydrocarbons, in proportion of up to 50% of the extracted fluid volume. Therefore, the minimal volume of pristine formation fluid that the vessels 30*a* and 30*b* should hold may be on the order of 20 $cm^3$. Larger volumes of pristine formation fluid may be captured in the vessels 30*a* and 30*b*, but it should be appreciated that when heating is used to mobilize the formation, the time required for sampling is increased when larger volumes are acquired.

Usually, samples acquired by formation testers contain drilling fluid filtrate, with or without solid suspension (mostly sand), in addition to pristine formation fluid. In the case of, heavy oil or bitumen reservoirs, and generally reservoirs where the formation fluid has a viscosity value in excess of approximately 100 cP, the reservoir fluid has generally three properties that significantly reduce (or even negate) the probability the drilling lubricant will flow in the formation. Indeed, in these viscous hydrocarbon reservoirs, the compressibility of the formation fluid is at least an order of magnitude lower than that of conventional oil, the viscosity of the formation fluid is at least 10 times greater than that of conventional oil, and the Gas-to-Oil Ratio (GOR) is lower than that of conventional oil. If filtrate invasion in the formation is minimal, as suggested above, the fluid collected with the tester tool 26 may have minimal drilling fluid contamination. Thus, the need to remove filtrate from the formation prior to take a sample may be reduced. However, the tool 26 is capable of ejecting a bad sample into the wellbore if desired, for example by retracting the probe and recycling the piston in the vessels 30*a*, 30*b*.

Alternatively, the testing tool 26 may be configured to pump filtrate from the invaded zone from above and below the probe. Such technique is known in the art and is usually referred to as "guard sampling" or "focused sampling". This technique may be advantageous in horizontal wells when the horizontal permeability is larger than the vertical permeability. As shown, the probes 21*a* and 21*b* are provided with a guard inlet selectively coupled to a guard flow-line 42 via a valve 35*c*. The guard flow line is coupled to a pump (not shown). The pump is used to extract unwanted mud filtrate before and/or during filling the sample vessels 30*a* or 30*b*. A sensor 36*c* may be provided for distinguishing between mud filtrate and formation fluid flowing in the flow-line 42. When formation fluid is detected, one of the vessel 30*a* or 30*b* may be used to capture a mobilized formation fluid sample.

In yet another alternative (not shown), the testing tool 26 may be configured to implement sampling using a technique sometimes referred to as "reverse low shock". This technique may also provide a low flow line volume between the sampling probe and the sample vessel. For example, a sample vessel is provided between a sampling probe and a pump. The sample vessel may be selectively bypassed using a bypass flow line and suitable valve configuration. Optionally, the samples may be pressurized above formation pressure by reversing the pump direction.

Figure 4A:
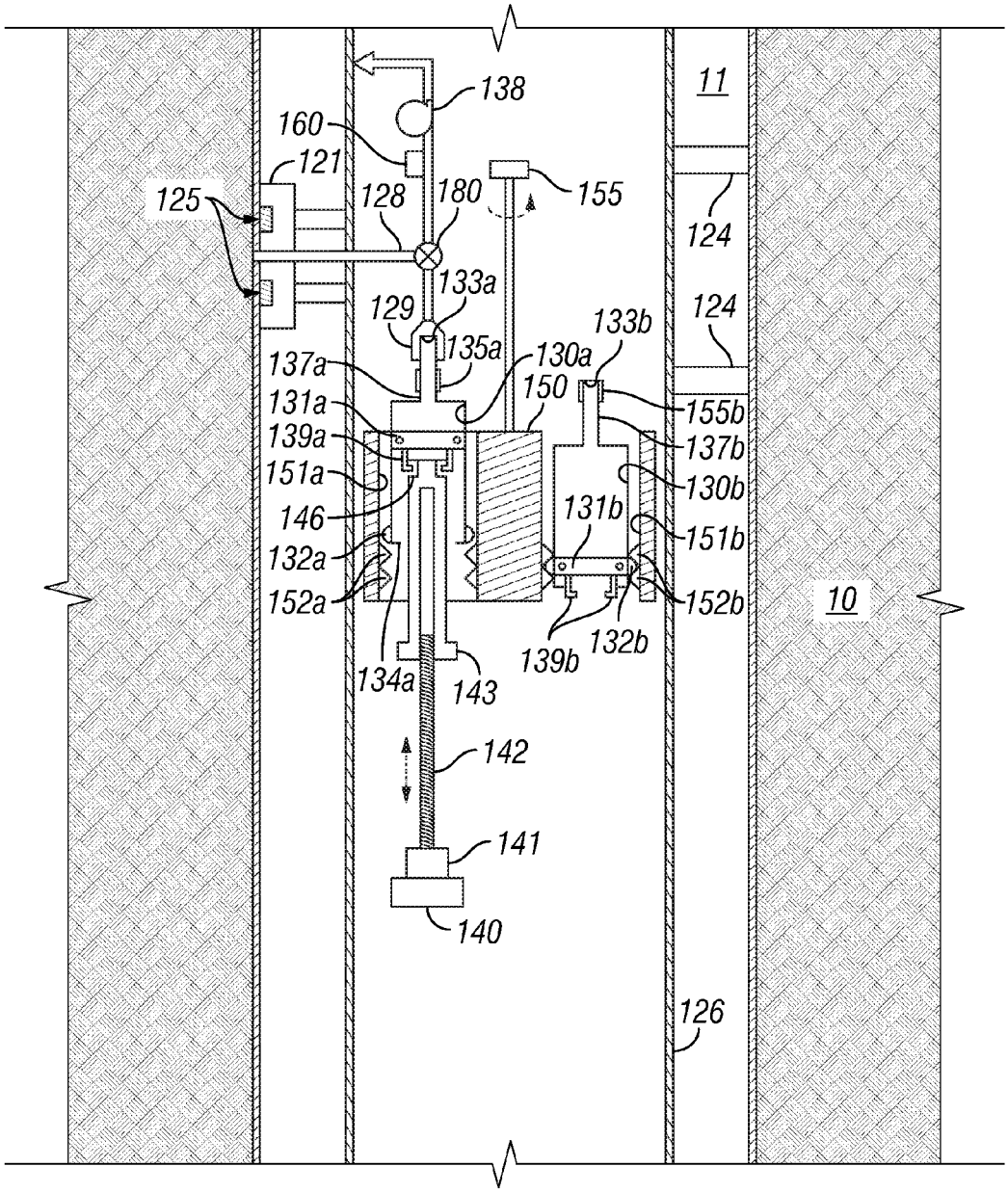
FIG. 4A is a schematic cross sectional view of a testing tool lowered in a wellbore having a low flow-line volume between a sampling port and one of a plurality of sample storage vessels disposed in a revolving chambered cylinder.

FIG. 4A shows a diagram of a testing tool 126 lowered in a wellbore 11 penetrating a formation 10. The testing tool 126 could be conveyed by wire-line, drill-pipe, or tubing or any other means used in the industry. For the sake of brevity and clarity, only a portion of the components of the tool 126 are depicted in FIG. 4A.

In FIG. 4A, a testing tool 126 is depicted in a sampling position. The testing tool 126 is provided with a probe 121 similar to the probe 1116 and/or 1152 of FIGS. 1 and 2B respectively. The probe 121 may be provided with means for mobilizing the hydrocarbon in the formation 10 , for example similar to means for mobilizing of the hydrocarbon in the formation 10 discussed in the description of FIG. 3. The probe 121 defines a sampling port or inlet of the testing tool 126, through which fluid may enter the tool. In the extended position, the probe 121 is pressed against a wall of the wellbore 11 with setting pistons 124. When set, the probe 121 sealingly engages a wall of the wellbore 11, establishing thereby an exclusive fluid communication between a flow-line 128 and the formation 10.

The testing tool 126 may be provided with a plurality of sample storage vessels, such as vessels 130*a* and 130*b*. The sample storage vessels 130*a* and 130*b* are disposed in chambers 151*a* and 151*b* respectively, of a revolving chambered cylinder 150. The cylinder 150 is rotatably disposed within the tool 126. The cylinder 150 is operatively coupled to an actuator 155 (e.g. a motor) for moving the cylinder 150 between a plurality of positions. In each position, an end 129 of the flow-line 128 registers with a neck of a sample storage vessel. As shown in FIG. 4A, the neck 137*a* of the vessel 130*a* registers with the end 129 of the flow line 128. By revolving the cylinder 150 by half a turn with the actuator 155, the neck 137*b* of the vessel 130*b* would register with the end 129 of the flow line 128 (not shown).

To secure the vessels 130*a* and 130*b* in the chambers 151*a* and 151*b* respectively, the cylinder 150 is provided with a notch defined by the protuberances 152*a* and 152*b* and the vessels 130*a*, 130*b* are provided with bosses 132*a* and 132*b* respectively. In FIG. 4A, the vessel 130*a* is shown in a sampling position in which the neck 137*a* sealingly engages the end 129 of the flow line 128, and the vessel 130*b* is shown in a storage position in which a boss 132*b* affixed to the vessel 130*b*, latches onto the protuberances 152*b*, thereby securing the vessel 130*b* in the chamber 151*b*. The vessels 130*a* (as shown) and 130*b* (not shown) may be moved between sampling and storage position with the ram 143 as further detailed below.

To seal fluid within the sample vessels 130*a* and 130*b*, the neck 137*a* and 137*b* of the vessels are provided with self-sealing valves 135*a* and 135*b* respectively. In FIG. 4A, the valve 135*a* is shown in an open position in which a flow aperture 133*a* allows for fluid to flow in or out of the vessel 130*a*, and the valve 135*b* is shown in a closed position in which flow through a flow aperture 133*b* of the vessel 130*b* is prevented. The valves 135*a*, 135*b* are maintained in a normally closed position, for example with a spring (not shown).

To move the vessel 130*a*, 130*b* between storage and sampling positions and/or to slide a piston 131*a*, 131*b*, respectively, within the vessel 130*a*, 130*b* the tool 126 is provided with, for example, a ram 143 in threadable engagement with a lead screw 142. The lead screw 142 may be rotated in both directions with a motor 140, preferably via a gear box 141 operatively coupled therebetween. Thus, the ram 143 may be moved up and down. Preferably, the displacement, and/or the force applied by the ram 143 on the piston 131*a* 131*b* are sensed and controlled during operations of the tool 126, for example using current sensors, and/or position sensors (not shown) coupled to the motor.

In operations, the cylinder 150 may be provided with a plurality of vessels, all disposed in a storage position (as shown with respect to vessel 130*b*). The ram 143 may initially be in a retracted position in which it does not engage with the cylinder 150 (not shown). As a formation of interest is reached by the testing 126, the probe 121 and the setting pistons may be extended (as shown). The cylinder 150 may be rotated to register one still empty vessel of the plurality of vessels (the vessel 130*a* in FIG. 4A) with the end 129 of the flow line 128. Then, the ram 143 may be extended to move the selected vessel (the vessel 130*a* in FIG. 4A) into a sampling position in which a fluid communication between the flow line 128 and an interior of the vessel is established. Also, as the ram 143 extends, hooks 139*a*, 139*b* affixed to the piston 131*a*, 131*b* respectively, may latch onto a groove 146 of the ram 143, thereby operatively coupling the piston 131*a* 131*b* to the ram 143.

Next, formation fluid sampling may begin. If desired, formation fluid in the vicinity of the probe 121 may be mobilized. Then, fluid (mobilized fluid) may be drawn from the formation into the vessel 130*a* by retracting the ram 143. As mentioned before, the retraction rate should be controlled to insure a representative sample is captured. The piston 131*a* may be moved until it reaches a shoulder 134*a* of the vessel 130*a*. As the ram 143 further retracts, the vessel 130*a*moves back into a storage position, in which the vessel 130*a* is secured within the chamber 151*a*with the boss 132*a* engaged in the notch defined by protuberances 152*a*. Also, as the neck 137*a* disengages from the flow line 128, the self sealing valve 135*a* returns to its normally closed position, sealing thereby the fluid in the vessel 130*a*. As the ram 143 still further retracts, the hooks 139*a* unlatch from the ram 143.

Figure 4B:
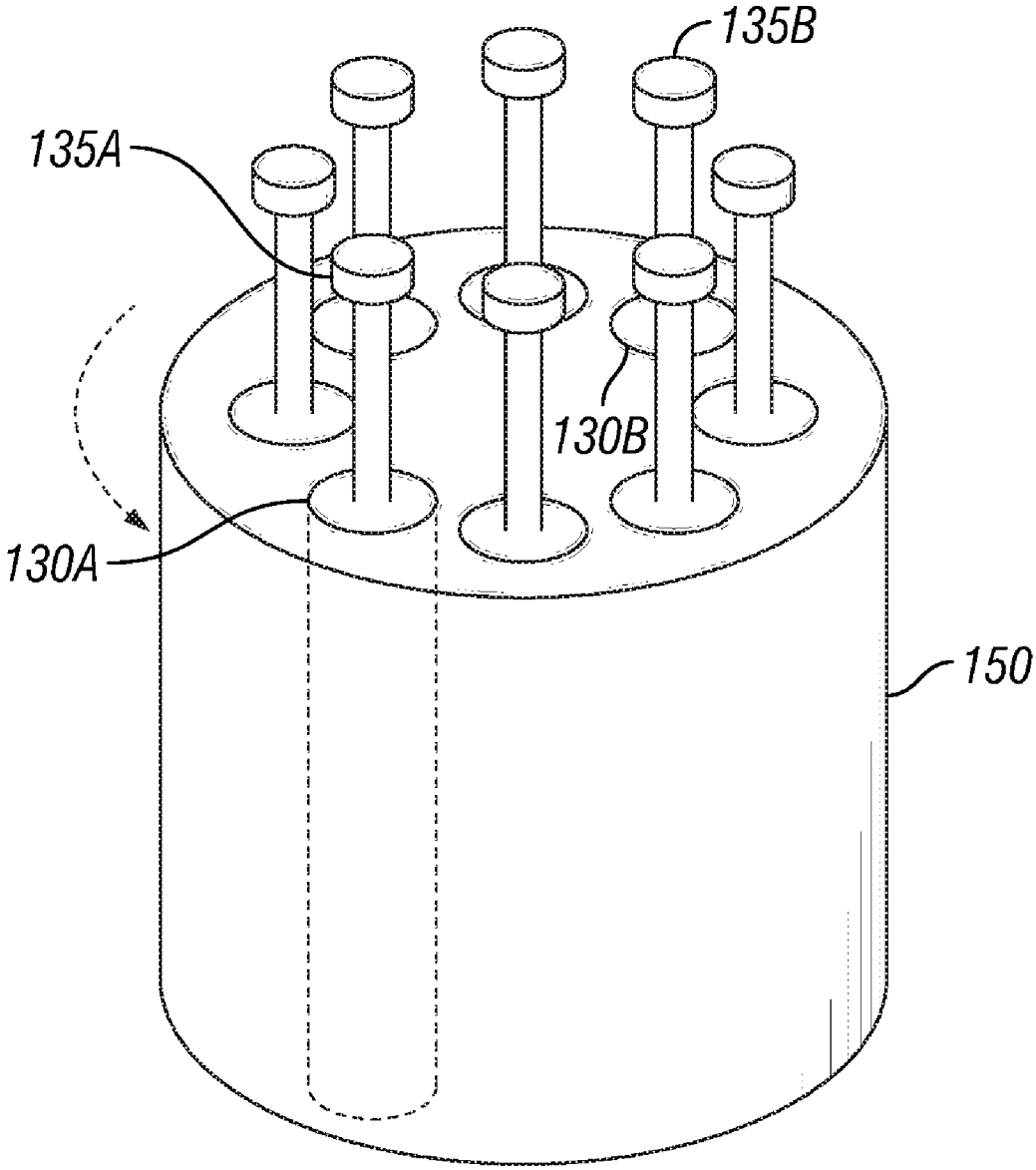
FIG. 4B is a schematic perspective view in of the revolving chambered cylinder shown in FIG. 4A.

FIG. 4B is a perspective view showing in more details of the revolving chambered cylinder 150 shown in FIG. 4A, as well as the vessels 130*a*, 130*b* and their respective self-sealing valves 135*a*, 135*b*. As shown in FIG. 4B, the cylinder 150 may include an array of sample vessels (e.g. more than two vessels) that can rotate about a pivot located about the axis of symmetry.

While the vessels in FIGS. 4A and 4B serve as syringe pump, the tool 126 may be provided with an additional pump 138 coupled to the flow line 128. The pump 138 may be used to selectively extract mud filtrate from the formation and dispose it in the wellbore 11. A sensor 160 may be disposed on the flow line 128 and be used to distinguish between mud filtrate and connate formation fluids. Based on data provided by the sensor 160, a valve 180 may be actuated to selectively admit connate formation fluid in the vessel 130*a*. In one example, the pump 138 may be implemented using a syringe pump. In this example, formation hydrocarbon may be drawn in the syringe pump and then a selected vessel may be filled by expulsing the formation hydrocarbon from the syringe pump into the selected vessel (see FIG. 5 for example).

Figure 5:
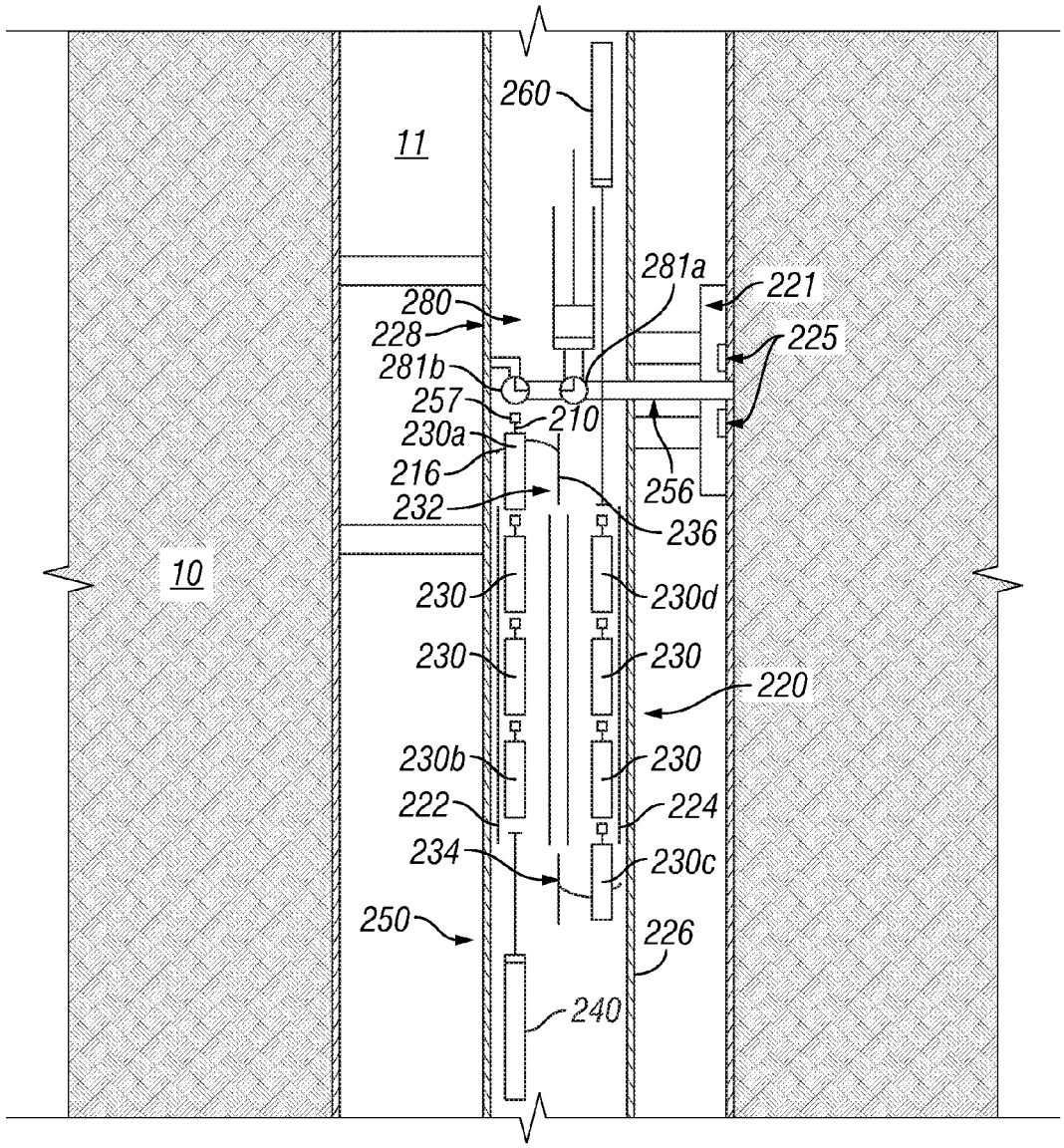
FIG. 5 is a schematic cross sectional view of a testing tool lowered in a wellbore having a low flow-line volume between a sampling port and one of a plurality of sample storage vessels disposed in a carousel.

FIG. 5 shows a diagram of a testing tool 226 lowered in a wellbore 11 penetrating a formation 10. The testing tool 226 could be conveyed by wire-line, drill-pipe, or tubing or any other means used in the industry. For the sake of brevity and clarity, only a portion of the components of the tool 226 are depicted in FIG. 5.

The testing tool 226 is provided with a probe 221 similar to the probe 1116 or 1152 of FIG. 1 or 2B, respectively. The probe 221 may be provided with means 225 for mobilizing of the hydrocarbon in the formation, for example similar to the means for mobilizing of the hydrocarbon in the formation 25*a* discussed in the description of FIG. 3. The probe 221 defines a sampling port or inlet of the testing tool 226, through which fluid may enter the tool. In the extended position, the probe 221 is pressed against a wall of the wellbore 11. When set, the probe 221 sealingly engages a wall of the wellbore 11, establishing thereby an exclusive fluid communication between a flow-line 256 and the formation 10.

A syringe pump 280 is provided for flowing fluid in the testing tool 226. In the shown example, the syringe pump 280 is in selective fluid communication with the flow line 256 through a valve 281. In a fist position (not shown) of the valve 281*a*, fluid is extracted from the formation as a drawdown piston included in the pump 280 is retracted. In a second position of the valve 281*a*, fluid received in the pump 280 may be expulsed from the pump towards an end 257 of the flow line 256 as the drawdown piston included in the pump 280 is extended. The end 257 of the flow line 256 may be in fluid communication with one of a plurality of sample storage vessels 230 disposed in a carousel, and configured to store the expulsed fluid from the syringe pump 280. The carousel may be disposed proximate the probe inlet, so that the volume of the interconnecting flow line is small compared with the volume of mobilized hydrocarbon obtained from the formation. Thus, the majority of mobilized hydrocarbon obtained from the formation may be stored in one of the storage vessels in the carousel. Further, a valve 281*b* may be used to selectively dispose unwanted fluid into the wellbore 11, for example based on data collected by a flow line sensor (not shown).

The testing tool 226 includes a system for efficiently handling and storing multiple sample storage vessels. Accordingly, the testing tool 226 may include a vessel carousel 220 having at least one of first and second storage columns 222, 224 each sized to receive vessels 230 adapted to hold fluid samples. In the illustrated embodiment, each storage column 222, 224 is shown holding four vessels 230, however, the columns may be sized to hold more or less than four vessels depending on the dimensions of the vessel carousel 220. The vessel carousel 220 defines a proximal end 228 positioned nearer to the flow line 256 and a distal end 250 positioned farther from the flow line 256.

Shifters 232, 234 may be provided to move vessels between the storage columns 222, 224. In the illustrated embodiment, the shifter 232 is coupled to the vessel carousel proximal end 228 and includes fingers 216 adapted to grip an exterior of one vessel 230. The shifter 232 is mounted on a spindle 236 and may rotate from a first position in which the shifter 232 registers with a proximal end of the first storage column 222, to a second position in which the shifter registers with a proximal end of the second storage column 224. The other shifter 234 is coupled to the vessel carousel distal end 250 and is similarly rotatable between a first position in which the shifter 234 registers with a distal end of the first storage column 222 and second position in which it registers with a distal end of the second storage column 224.

A first transporter is provided for transferring an empty vessel from the first storage column 222 up to the proximal shifter 232 and into sealing engagement with the flow line 256 as it moves from the retracted position to an extended position. In the illustrated embodiment, the first transporter comprises a lift piston 240, such as a ball screw piston, which is positioned coaxially with respect to the receptacle first storage column 222 and is further coaxial with an end 257 of the flow line 256. In its extended position, the lift piston 240 also passes through the distal shifter 234 and is configured to advance a vessel 230 from the distal shifter 234 to the first storage column 222.

A second transporter, such as push down piston 260, may be provided to transfer a filled vessel 230 from the proximal shifter 232 to the second storage column 224. As shown in FIG. 5, the push down piston 260 is coaxial with the second storage column 224 and adapted to move from a retracted position to an extended position in which it passes through the proximal shifter 232 and partially into the second storage chamber 224. As it moves to the extended position, the push down piston 260 will transport a vessel disposed inside the proximate shifter 232 into the second storage column 224. Also, the push down piston 260 will transport a vessel disposed inside the second storage column 224 into the distal shifter 234.

Each vessel 230 is provided with an auto-connect and normally closed (or self-closing) valve assembly disposed on a neck thereof. Each vessel may be filled when connected to the end 257 of the flow-line 256 with formation fluid (e.g. mobilized hydrocarbon) that has been drawn previously in the syringe pump 280. Further, each vessel 230 is preferably provided with a spring 210, or other compliant material, that is compressed as the neck of vessel 230 is engaged into the end 257 of the flow line 256. The spring may then provide a force for disengaging the neck of the vessel from the end 257 of the flow line 256. The spring may also assist load transmission between vessels in the storage columns while protecting the connecting mechanism thereof. Still further, the vessels may include a sliding piston (not shown) having one face in fluid communication with fluid (e.g. wellbore fluid, hydraulic oil) that may be present in at least one storage column 222 or 224 as the other face is in fluid communication with the fluid sample flowing through the inlet of the probe 221.

In operation, the handling assembly may be used to transfer vessel between the carousel 220 and the end 257 of the flow-line 256, and store vessels in multiple adjacent storage columns. Prior to lowering the tool 226 in the wellbore 11, the first and second storage columns 222, 224 of the carousel 220 may be filled with empty vessels. The vessels may be of any type capable of receiving and storing fluid samples. These would include a first vessel 230*a* positioned at a proximal end of the first storage column 222 and a second vessel 230*b* positioned at a distal end of the first storage column 222. In addition, a third vessel 230*c* is positioned at a distal end of the second storage column 224 and a fourth vessel 230*d* is positioned at a proximal end of the second storage column 224.

The sampling probe 221 and the syringe pump 280 may be operated to obtain formation fluid in the syringe pump 280. The lift piston 240 may then be extended so that the vessel 230*a* is ejected from the first storage column 222. The proximal shifter 232 may be positioned to register with the first storage column, thereby to receive the ejected vessel 230*a*. Further extension of the lift piston 240 sealingly engages the vessel 230*a* into the end 257 of the flow line 256 and compresses the spring 210. The valve 281 may then be activated to fluidly connect the pump 280 to the vessel 230*a*, and the fluid captured in the pump may be transported into the vessel 230*a*. Partial retraction of the lift piston 240 permits the spring 210 to extend and to disengage the vessel 230*a* from the flow line 256. The distal shifter 234 may then rotate to register with the first storage column 222, thereby transferring the vessel 230*c* to be positioned adjacent the distal end of the first storage column 222. By this time, the lift piston 240 may be at least partially retracted so that it is clear of the distal shifter 234.

Next, the push down piston may be retracted so that it is clear of the proximal shifter 232. The proximal shifter 232 may then be rotated to register with the second storage column 224 and the push down piston 260 may be extended to insert the vessel 230*a* into the second storage column proximal end. As the vessel is inserted into the second storage column 224, the entire second series of stacked vessels is advanced in a distal direction along the second storage column 224 thereby ejecting a vessel from the distal end of the second storage column 224. The distal shifter 234 may be positioned to register with the second storage column 224, thereby to receive the ejected vessel. The above steps may then be repeated until each vessel contains a sample.

Figure 6:
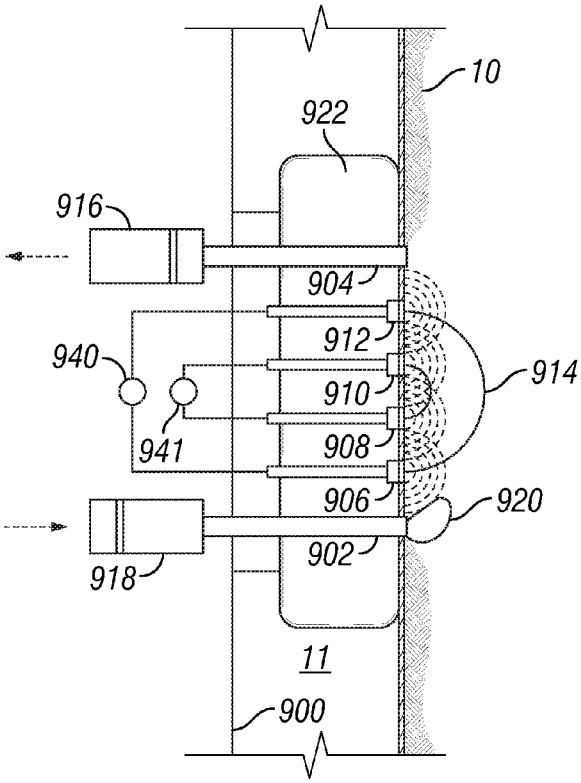
FIG. 6 is a schematic cross sectional view of a packer of a testing tool according to one or more aspects of the present application.

FIG. 6 shows a detailed diagram of means for mobilizing fluid in the formation that can be used the testing tools of the present disclosure. The testing tool 900 also includes an injection pump 918 coupled to an injection port 902. In operation, with the example configuration 900 of FIG. 6, as the electrodes 906-912 heat the subterranean formation 10, the injection pump 918 may apply a pressure to a displacement fluid 920 (e.g. a solvent, a diluents), which applies pressure to the fluid within the subterranean formation 10.

The testing tool 900 is provided with a plurality of electrodes 906, 908, 910, and 912 that are arranged between the injection port 902 and the sampling port 904 to heat a volume of the formation 10 proximate to the sampling port 904. One or more electrical power sources (940, 941) may be coupled to the electrodes 906-912 to flow current in the formation along, for example, lines or paths 914. Because of the resistance of the formation, the current may be dissipated into heat in the portion of the formation. Accordingly, the temperature of the hydrocarbon in the volume located between the injection port and the sampling port may increase, thereby reducing its viscosity. The power source field may operate at frequencies from DC to several GHz.

A pressure sensor (not shown) may monitor the pressure applied by the displacement fluid 920 on the fluid in the subterranean formation 10. As the fluid within the heated portions of the subterranean formation 10 becomes increasingly mobile, the pressure on the displacement fluid 920 decreases. The drop in pressure may be compensated by increasing or decreasing the amount of force applied to displacement fluid 920 by the injection pump 918. The pressure from the displacement fluid 920 causes a sample of the mobile fluid in the heated portion of the subterranean formation 10 to flow into the sampling port 904.

Extending on both sides of the ports 902 and 904 there is a packer 922, which is deployed against the wellbore wall in the circumferential direction to seal a substantial portion of a perimeter of the wellbore 11. As the injection pump 918 exerts pressure on the displacement fluid 920, the displacement fluid 920 is pushed into the subterranean formation 10 and exerts pressure in every direction. Hydraulic shorting may occur between the injection port 902 and the wellbore 11. Also, the heated formation fluid may flow into the wellbore 11 instead of the production port 904. The packer 922 seals the wellbore, and prevents hydraulic shorting between the wellbore 11 and the formation 10.

The syringe pump 916 may assist the flow of the fluid sample by drawing in the fluid sample. The syringe pump 916 is used to reduce the parasitic volume of fluid associated with the testing tool 900. Such a reduction of the parasitic volume of fluid enables a relative reduction in the amount of formation to be heated and, thus, time needed to collect a given fluid sample volume. It should be noted that when solvent injection is used, adaptations of the sample collection vessel volume may be required to acquire a sufficient volume of hydrocarbon from the formation, owing to the volume occupied by the solvent present in the formation fluid. Modifications of the testing tool may also be required to accommodate instrument to identify and quantify the presence of solvent that may have contaminated the hydrocarbon sample. These instruments may include components of the existing Optical Fluid Analyzer that measure fluid color amongst other optical properties, or other sensors that measure of fluid resistivity.

Figure 7A:
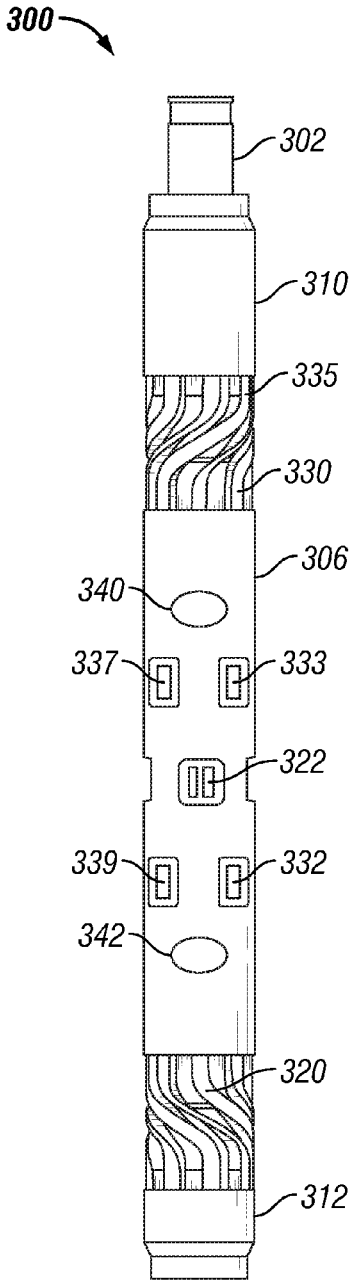
FIG. 7A is a schematic perspective view of another packer of a testing tool according to one or more aspects of the present application.
Figure 7B:
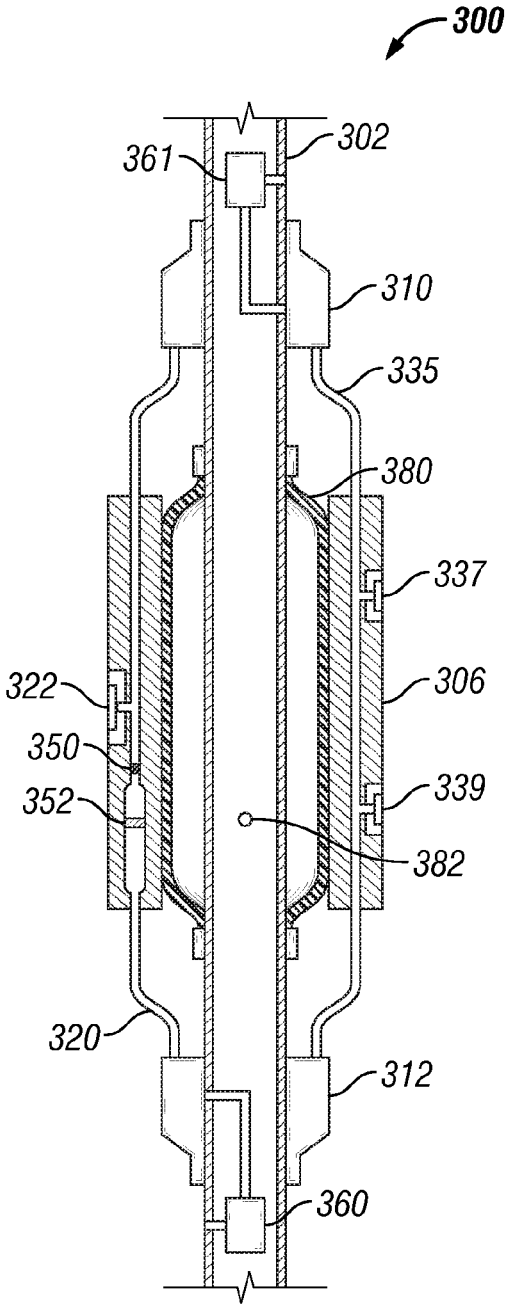
FIG. 7B is a schematic sectional view of the packer shown in FIG. 7A.

FIGS. 7A and 7B show a portion of another formation tester 300 according to one or more aspect of this disclosure. The formation tester 300 shown in FIGS. 7A and 7B may be referred to as a "single packer" formation tester. It should be understood that FIGS. 7A and 7B omit a number of elements for clarity of the illustration that are well known to those skilled in the art. Thus, the exact configuration of the formation tester 300 shown in FIGS. 7A and 7B may be the same or different than as shown, the figures being only one example of a single packer formation tester configuration.

Similarly to the testing tool 900 of FIG. 6, the formation tester 900 is provided with an outer sealing layer 306, such as can be made from an elastomer such as a fluorocarbon polymer, that is configured to sealingly engage a substantial portion of a perimeter of a wellbore wall (not shown). The sealing layer 306 can be made to contact the wellbore wall to create a seal, for example by inflation via an inflation port 382 of a sleeve 380 disposed around a mandrel 302 of the formation tester 300.

The sealing layer 306 is traversed by a plurality of C shaped flow lines, for example, 320, 330 and 335. The flow lines are rotatably affixed between fluid collectors 310 and 312. Upon inflation of the sleeve 380, the flow lines 320, 330 and 335 may pivot in the collectors 310 and 312 and a middle portion of the flow lines may extend in a general radial direction away from the mandrel 302. Conversely, upon deflation of the sleeve 380, the flow lines 320, 330 and 335 may pivot in the collectors 310 and 312 and a middle portion of the flow lines may retract in a general radial direction towards the mandrel 302. In the example of FIGS. 7A and 7B, the flow line 320 is fluidly coupled to a first pump 360 (e.g. a progressive cavity pump) via the fluid collector 312, and the flow lines 330 and 335 are fluidly coupled to a second pump 361 (e.g. a progressive cavity pump) via the fluid collector 310. While three flow lines connected to two pumps are described herein, the formation tester 300 may include less or more flow lines, connected to one or more pumps.

A first plurality of openings or ports 332, 333, 337, and 339 may be disposed at selected positions through the sealing layer 306. In the example of FIGS. 7A and 7B the ports 332 and 333 are hydraulically connected the flow line 330, and the ports 337 and 339 are hydraulically connected a flow line 335. At least one inlet or port 322 may further be disposed at a selected position through the sealing layer 306. In the example of FIGS. 7A and 7B the port 322 is hydraulically connected the flow line 320. In an extended position of the sealing layer 306, the ports 332, 333, and 337 establish a fluid communication between the formation and one of the flow lines 320, 330 or 335. For example, the ports 332, 333, and 337 may be used to inject a displacement fluid (e.g. wellbore fluid) into the formation upon actuation of the pump 361, similarly to the formation tester of FIG. 6. Alternatively, the ports 332, 333, and 337 may be used to draw fluid (e.g. mud filtrate) from the formation. Also, the port 322 may be used to draw formation fluid into the formation tester 300 upon actuation of the pump 360. While five ports connected to two pumps are described herein, the formation tester 300 may include less or more ports, connected to one or more pumps.

A plurality of heat sources, for example 340, 342 may be evenly or otherwise spatially distributed in the sealing layer 306 near the outer surface of the sealing layer 306. For example, the heat sources 340, 342 may be configured to emit electromagnetic energy into the formation at a frequency selected to heat any residual water within the pore space of the formation. Because the heat sources 340, 342 are spatially distributed in the sealing layer 306, by appropriate selection of particular ones of the heat sources 340, 342 to be actuated, the efficiency of the propagation of heat through the formation can be maximized. Optionally, the flow lines 320, 330 and 335 may also be heated, for example, by electric resistance heating elements (not shown) to maintain movement of fluid from the formation by reducing the amount of cooling-associated increase in viscosity.

As mentioned before, one or more ports 322 disposed through the sealing layer 306 may be used to withdraw samples of formation fluid for capture. In this case, the port 322 may be in hydraulic communication with a sample chamber implemented in the flow line 320. The flow line 320 may comprise a piston 352, optionally disposed in an enlarged portion of the flow line 320. As shown in FIG. 7B, the piston 352 fluidly isolates a fluid flow path between the port 322 and the pump 360. The flow line may further comprise a valve 350 configured to seal a sample in the flow line 320. A portion of the flow line 320 may thus be used as a vessel to admit and capture a formation fluid. Once the sampling operation is completed, the flow line 320 (together with the sealing layer 306) may be detached from the formation tester at the surface, placed in a pressure safe container, and transported to a laboratory. Alternatively, the captured fluid can be drained at the wellsite.

Optionally, the flow line 320 may include additional valves (not shown) disposed between the piston 352 and pump 360 and configured to be closed to further secure the sample of formation fluid captured in the sample chamber implemented in the flow line 320. For example, the additional valves may be disposed in the collector 312.

Figure 7C:
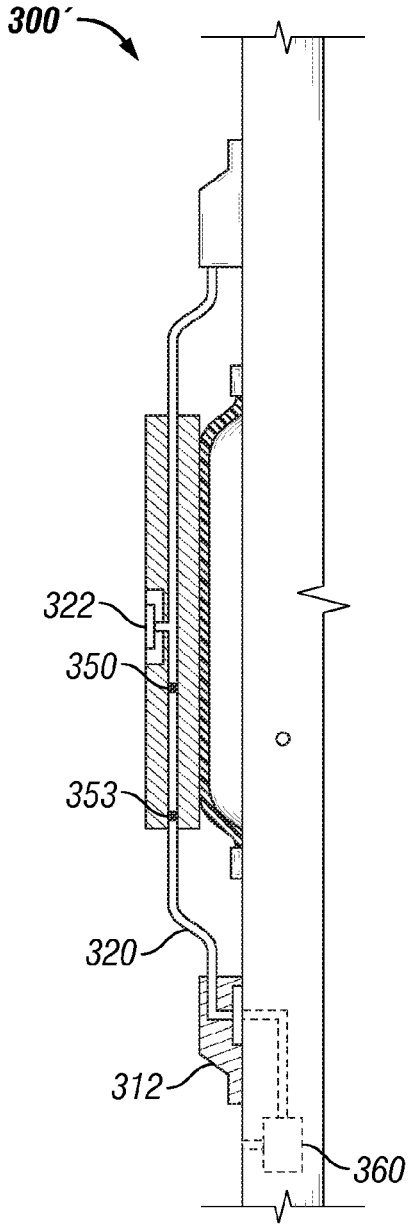
FIG. 7C is a schematic half sectional view of another embodiment of the packer shown in FIG. 7A.

FIG. 7C shows another configuration 300' of the formation tester shown in FIG. 7A. In this configuration, the flow line 320 extending from the inlet 322 is provided with a first valve 353 defining a first volume extending between the inlet 322 and the valve 353, and a second volume extending between the pump 360 and the valve 353. After formation fluid is mobilized, the pump 360 may be used to extract fluid from the formation. When a formation sample is received in the first volume, the valves 350 and 353 may be closed, thereby capturing the formation sample between the valves. This configuration may be useful for removing some contaminated fluid from the formation through the flow line 320 before a representative sample is captured. In other words, valves 350 and 353 would remain open during pumping until such time that it has been determined to capture a sample of formation fluid whereupon valves 353 and 350 would be closed to secure a sample of the desired fluid.

In view of all of the above and FIGS. 1 to 7, it should be readily apparent to those skilled in the art that the present disclosure provides a downhole tool, for use in a borehole formed in a subterranean formation, and comprising a formation fluid mobilizer configured to mobilize a formation fluid; a vessel comprising a piston slidably disposed therein and defining first and second volumes, wherein the first volume is configured to receive at least a portion of the mobilized formation fluid from an inlet port; and an actuator operatively coupled to the piston, the actuator being fluidly isolated from a fluid flow path extending between the inlet port and the first volume. The downhole tool may further comprise a valve configured to control the flow of the formation fluid to the vessel. The formation fluid mobilizer may comprise a heat source. The heat source may comprise an electromagnetic transducer. The actuator may comprise a pumping mechanism configured to at least one of lower a hydraulic oil pressure in the second volume, and extract hydraulic oil out of the second volume. The actuator may comprise a ram configured to reciprocate the piston. The downhole tool may further comprise a plurality of vessels; and a plurality of inlet ports, wherein first and second vessels from the plurality of the vessels are fluidly connected respectively to first and second inlet ports from the plurality of inlet ports. At least one of the plurality of inlet ports may be disposed on a probe configured to selectively extend from the downhole tool. At least one of the plurality of inlet ports may be disposed on a packer configured to deploy against a substantial portion of a perimeter of the borehole. At least one of the vessels may be disposed in the packer. The downhole tool may further comprise a plurality of vessels; a flow-line configured to transfer the formation fluid to at least one vessel from the plurality of vessels; and an actuator configured to register an end of the flow-line with an inlet of the at least one vessel. The at least one vessel may be a first vessel, the plurality of vessels may comprise a second vessel, and the actuator may be configured to register the end of the flow-line with inlets of the first and second vessels respectively in first and second positions. The downhole tool may further comprise a storage column configured to secure the at least one vessel, and the actuator may be configured to register the end of the flow-line with an inlet of the at least one vessel in a first position and to register the at least one vessel with an opening of the storage column in a second position. The downhole tool may be configured to be lowered in the borehole using one of a wireline cable, a tubing, and a drill string.

The present disclosure also provides a method for obtaining a sample of formation fluid. The method includes lowering a downhole tool in a borehole formed in a subterranean formation, the downhole tool comprising a vessel comprising a piston slidably disposed therein and defining first and second volumes; and an actuator operatively coupled to the piston, the actuator being fluidly isolated from a fluid flow path extending between an inlet port and the first volume. The method further includes mobilizing a formation fluid in the formation; operating the actuator to slide the piston in the vessel; and receiving in the first volume at least a portion of the mobilized formation fluid from the inlet port.

The present disclosure also provides a downhole tool, for use in a borehole formed in a subterranean formation, and comprising an inlet port configured to admit a formation fluid in the downhole tool; a vessel configured to receive the formation fluid, the vessel having a valve configured to selectively close an inlet of the vessel; a flow-line configured to deliver the formation fluid from the inlet port to the vessel; and an actuator configured to register an end of the flow-line with the inlet of the vessel. The valve may be a self-closing valve. The downhole tool may further comprise a plurality of vessels; and a revolving chambered cylinder configured to secure at least one vessel from the plurality of vessels and, wherein the actuator of operatively coupled to the revolving chambered cylinder. The downhole tool may further comprise a plurality of vessels; and a storage column configured to secure at least one vessel from the plurality of vessels and, wherein the actuator comprises a shifter configured to register an end of the flow-line with the inlet of the at least one vessel in a first position and to register the at least one vessel with an opening of the storage column in a second position. The downhole tool may further comprise a heat source configured to increase a temperature of a formation fluid.

The present disclosure also provides a method for obtaining a sample of formation fluid. The method includes lowering a downhole tool in a borehole formed in a subterranean formation, the downhole tool comprising a flow-line extending from an inlet pot, a first valve disposed on the flow line and defining first and second volumes, a pumping mechanism operatively coupled to the second volume, and a second valve configured to capture the formation fluid in the first volume. The method further includes mobilizing a formation fluid in the formation, operating the pumping mechanism to flow fluid in the flow-line, receiving in the first volume at least a portion of the mobilized formation fluid from the inlet port, and actuating the first and second valves to capture the formation fluid in the first volume.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A downhole tool for use in a borehole comprising:

a sampling port for receiving formation fluid from a formation about a borehole;

a flow line in fluid communication with the sampling port for transporting the formation fluid within the downhole tool;

a sample storage vessel in fluid communication with the sampling port, the sample storage vessel having a self-sealing valve;

a ram in contact with the sample storage vessel to move the sample storage vessel into a sampling position in contact with the flow line to open the self-sealing valve and establishing fluid communication with an interior of the sample storage vessel, and further wherein retracting the ram moves the sample storage vessel into a storage position that is not in fluid communication with the flow line, and further wherein the self-sealing valve automatically closes upon moving to the storage position.

2. The downhole tool of claim 1 further comprising a piston within the sample storage vessel, wherein the ram contacts the piston to move the sample storage vessel between the storage position and the sampling position.

3. The downhole tool of claim 2 further comprising hooks affixed to the piston to latch onto the ram thereby operatively coupling the piston to the ram.

4. The downhole tool of claim 1 wherein retracting the ram between the sampling position and the storage position permits the sample storage vessel to be filled with the formation fluid.

5. The downhole tool of claim 1 further comprising a first chamber in a revolving chambered cylinder for disposing the sample storage vessel.

6. The downhole tool of claim 5 wherein the revolving chambered cylinder has a second chamber for storage of another sampling storage vessel, and further wherein the cylinder is rotably disposed within the tool.

7. The downhole tool of claim 6 wherein the first chamber has a protuberance and further wherein the sampling storage vessel has a boss latching into the protuberance.

8. The downhole tool of claim 1 further comprising a formation fluid mobilizer configured to mobilize a formation fluid by reducing viscosity of the formation fluid.

9. The downhole tool of claim 8 wherein the formation fluid mobilizer comprises a heat source.

10. The downhole tool of claim 1 wherein the sampling port is disposed on a packer configured to deploy against a substantial portion of a perimeter of the borehole.

11. The downhole tool of claim 10 wherein the sampling storage vessel is disposed in the packer.

12. A method for sampling a formation fluid in a borehole comprising:

lowering a downhole tool in the borehole formation in a subterranean formation, the downhole tool having a revolving chambered cylinder storing a plurality of sample storage vessels therein, and the downhole tool having a piston within each of the plurality of sample storage vessels and movable within each sample storage vessel;

sampling formation fluid about the borehole;

drawing the formation fluid into the downhole tool through a flow line within the downhole tool and into a first one of the sample storage vessels rotating the revolving chambered cylinder to draw formation fluid into a second one of the sample storage vessels; and providing a ram in contact with one of the sample storage vessels to move the one of the sample storage vessels into a sampleing position in contact with the flow line and further wherein retracting the ram moves the one of the sample storage vessels into a storage position that is not in fluid communication with the flow line.

13. The method of claim 12 further comprising moving the first sample storage vessel from a storage position within a chamber in the revolving cylinder to a sampling position in fluid communication with the flow line.

14. The method of claim 13 wherein moving the first sample storage vessel from the storage position to the sampling position comprises extending a ram in contact with the first sample storage vessel to move the first sample storage vessel into contact with the flow line to at least partially fill the first sample storage vessel.

15. The method of claim 13 wherein the first sample storage vessel has a self-sealing valve automatically closing in the storage position.

16. The method of claim 12 further comprising decreasing the viscosity of the formation fluid.

17. The method of claim 12 wherein the step of sampling formation fluid about the borehole utilizes a packer having a sampling port.

18. A downhole tool for use in a borehole comprising:

a sampling port for receiving formation fluid from a formation about a borehole;

a plurality of sample storage vessels rotatable within the downhole tool; and a ram for moving a first sample storage vessel from a storage position to a sampling position, the sampling port being in fluid communication with the first sample storage vessel at the sampling position; and further wherein retracting the ram moves the first sample storage vessel into the storage position that is not in fluid communication with the flow line.

19. The downhole tool of claim 18 further comprising a flow aperture providing fluid communication to an interior of the first sample storage vessel and a self-sealing valve at the aperture.

20. The downhole tool of claim 18 further comprising a fluid mobilizer for reducing the viscosity of the formation fluid.

21. The downhole tool of claim 18 further comprising a flow line connecting the sampling port to the first sample storage vessel at the sampling position and a sensor disposed on the flow line for distinguishing between mud filtrate and formation fluids.

* * * * *